US011203213B2

(12) United States Patent
Tanemoto

(10) Patent No.: US 11,203,213 B2
(45) Date of Patent: Dec. 21, 2021

(54) INKJET PRINTING DEVICE AND PRINT-MEDIUM HEATING METHOD OF INKJET PRINTING DEVICE

(71) Applicant: SCREEN Holdings Co., Ltd., Kyoto (JP)

(72) Inventor: Mitsuru Tanemoto, Kyoto (JP)

(73) Assignee: SCREEN Holdings Co., Ltd.

( * ) Notice: Subject to any disclaimer, the term of this patent is extended or adjusted under 35 U.S.C. 154(b) by 0 days.

(21) Appl. No.: 17/049,385

(22) PCT Filed: Nov. 2, 2018

(86) PCT No.: PCT/JP2018/040889
§ 371 (c)(1),
(2) Date: Oct. 21, 2020

(87) PCT Pub. No.: WO2019/187300
PCT Pub. Date: Oct. 3, 2019

(65) Prior Publication Data

US 2021/0245530 A1 Aug. 12, 2021

(30) Foreign Application Priority Data

Mar. 26, 2018 (JP) ..... JP2018-058205

(51) Int. Cl.
*B41J 11/00* (2006.01)

(52) U.S. Cl.
CPC ..... *B41J 11/00242* (2021.01)

(58) Field of Classification Search
CPC ..... B41J 11/00242
See application file for complete search history.

(56) References Cited

U.S. PATENT DOCUMENTS

2004/0009000 A1 1/2004 Mizuno ..... 399/45
2007/0188576 A1* 8/2007 Snyder ..... B41J 2/0057 347/103
2011/0267393 A1 11/2011 Okamoto ..... 347/14

FOREIGN PATENT DOCUMENTS

JP S63-306048 A 12/1988
JP H08-248795 A 9/1996
(Continued)

OTHER PUBLICATIONS

International Search Report dated Dec. 11, 2018 in corresponding PCT International Application No. PCT/JP2018/040889.
(Continued)

*Primary Examiner* — Bradley W Thies
(74) *Attorney, Agent, or Firm* — Ostrolenk Faber LLP

(57) ABSTRACT

An inkjet printing device including a transporter that transports a print medium, a printer that discharges ink droplets onto the print medium and a heat roller that includes a peripheral surface with which the print medium comes into contact after printing is provided. The peripheral surface of the heat roller includes a paper contact region and a non-paper region. The device further includes a first heater for the paper region, a second heater for the non-paper region, a target temperature setter that provides a target temperature at the paper region side, and a sensor that measures the temperature at the paper region side. The target temperature and a sensor output are referenced when heating by the first heater is performed, to judge whether supplementary heating of the paper region by the second heater is necessary. If supplementary heating is necessary, the second heater is driven by a drive signal having an intensity that corresponds to a deficient heat amount equivalent value in the paper region.

6 Claims, 7 Drawing Sheets

(56) References Cited

FOREIGN PATENT DOCUMENTS

| | | | |
|---|---|---|---|
| JP | H11-084926 | A | 3/1999 |
| JP | H11-115175 | A | 4/1999 |
| JP | 2001-109322 | A | 4/2001 |
| JP | 2001-212954 | A | 8/2001 |
| JP | 2002-067283 | A | 3/2002 |
| JP | 2004-045699 | A | 2/2004 |
| JP | 2006-184403 | A | 7/2006 |
| JP | 2008-284883 | A | 11/2008 |
| JP | 2009-012480 | A | 1/2009 |
| JP | 2010-008526 | A | 1/2010 |
| JP | 2011-095289 | A | 5/2011 |
| JP | 2011-230465 | A | 11/2011 |
| JP | 2017-007254 | A | 1/2017 |

OTHER PUBLICATIONS

Written Opinion dated Dec. 11, 2018 in corresponding PCT International Application No. PCT/JP2018/040889.

* cited by examiner

INKJET PRINTING DEVICE AND PRINT-MEDIUM HEATING METHOD OF INKJET PRINTING DEVICE

TECHNICAL FIELD

The present application is a 35 U.S.C. §§ 371 national phase conversion of PCT/JP2018/040889, filed Nov. 2, 2018, the contents of which are incorporated herein by reference which claims priority based on Japanese Patent Application No. 2018-58205 filed on Mar. 26, 2018 and the entire disclosure of this application is incorporated herein by reference. The PCT International Application was published in the Japanese language.

The present invention relates to an inkjet printing device that discharges ink droplets from an inkjet head to perform printing on a print medium and to a print medium heating method of the inkjet printing device.

BACKGROUND ART

In recent years, so-called "one-pass" type printers have been developed for the purpose of improving printing speed in an inkjet printer. This type of printer includes a transporting unit that transports a print medium in a transporting direction and a printing portion that discharges ink droplets onto the print medium to perform printing. The printing portion has a width that covers a full width of the print medium. With the one-pass type printer, the printing speed is improved because printing is performed while transporting the print medium. Also, a heater is disposed downstream in the transporting direction of the printing portion and the print medium after printing is dried efficiently. The printing speed is thereby improved further.

CITATION LIST

Patent Literature

Patent Literature 1: Japanese Patent Application Publication No. 2009-12480

SUMMARY OF INVENTION

Technical Problem

The transporting unit is in some cases arranged such as to be capable of transporting print media of various widths from narrow width to wide width. Accordingly, there are cases where a heater capable of changing a heating region in accordance with the width of the transported print medium is used (for example, Patent Literature 1).

An object of the present invention is to provide an inkjet printing device that includes a heater capable of switching a heating region and is capable of efficiently heating a print medium and a print medium heating method in such an inkjet printing device.

Solution to Problem

A preferred embodiment of the present invention provides an inkjet printing device including a transporting unit that transports a print medium, a printer unit that discharges ink droplets onto the print medium transported by the transporting unit to perform printing on the print medium, and a heat roller that is elongated in a direction orthogonal to a transporting direction of the print medium and includes a peripheral surface with which the print medium comes into contact after printing by the printer unit. The peripheral surface of the heat roller includes a paper region with which a full width or most of the print medium comes into contact and a non-paper region other than the paper region. The inkjet printing device further includes a first heater that is provided in correspondence to the paper region and heats the peripheral surface, a second heater that is provided in correspondence to the non-paper region and heats the peripheral surface, a target temperature providing means that provides a target temperature at the paper region side, and a sensor that measures a temperature at the paper region side. The inkjet printing device further includes a judging means that references the target temperature and an output of the sensor in a state where heating of the peripheral surface by the first heater is performed to judge whether or not supplementary heating of the paper region by the second heater is necessary and a heater drive circuit that drives the second heater by a drive signal of an intensity in accordance with a deficient heat amount equivalent value in the paper region if it is judged by the judging means that supplementary heating of the paper region is necessary.

With the present arrangement, it is judged whether or not supplementary heating of the paper region by the second heater is necessary. If it is judged that supplementary heating is necessary, the second heater is driven by the drive signal of the intensity in accordance with the deficient heat amount equivalent value in the paper region. The second heater can thus perform supplementary heating of the paper region with the necessary intensity and it becomes possible to heat the print medium efficiently.

In the preferred embodiment of the present invention, the first heater and the second heater are juxtaposed in an axial direction of the heat roller.

In the preferred embodiment of the present invention, a difference temperature between the target temperature and the sensor output is used as the deficient heat amount equivalent value in the paper region.

In the preferred embodiment of the present invention, a difference between a duty ratio of a drive signal for the first heater calculated from the sensor output and a maximum duty ratio of the drive signal for the first heater is used as the deficient heat amount equivalent value in the paper region.

In the preferred embodiment of the present invention, the heater drive circuit drives the second heater in consideration of a thermal contribution ratio of the second heater from the non-paper region to the paper region.

A preferred embodiment of the present invention provides a print medium heating method of an inkjet printing device including a transporting unit that transports a print medium, a printer unit that discharges ink droplets onto the print medium transported by the transporting unit to perform printing on the print medium, and a heat roller that is elongated in a direction orthogonal to a transporting direction of the print medium and includes a peripheral surface with which the print medium comes into contact after printing by the printer unit. The peripheral surface of the heat roller includes a paper region with which a full width or most of the print medium comes into contact and a non-paper region other than the paper region. The inkjet printing device further includes a first heater that is provided in correspondence to the paper region and heats the peripheral surface, a second heater that is provided in correspondence to the non-paper region and heats the peripheral surface, and a sensor that measures a temperature at the paper region side. The print medium heating method includes a target temperature providing step of providing a target temperature at the paper region side, a temperature measuring step of measuring a temperature at the paper region side in a state where heating of the peripheral surface by the first heater is performed and outputting a measured temperature, a judging step of referencing the target temperature and the measured temperature and judging whether or not supplementary heating of the paper region by the second heater is necessary, and a second heater driving step of generating a drive signal of an intensity in accordance with a deficient heat amount equivalent value in the paper region and driving the second heater if it is judged by the judging step that supplementary heating of the paper region is necessary.

With the present method, it is judged whether or not supplementary heating of the paper region by the second heater is necessary. If it is judged that supplementary heating is necessary, the second heater is driven by the drive signal of the intensity in accordance with the deficient heat amount equivalent value in the paper region. The second heater can thus perform supplementary heating of the paper region with the necessary intensity and it becomes possible to heat the print medium efficiently.

The aforementioned as well as yet other objects, features, and effects of the present invention will be made clear by the following description of the preferred embodiments with reference to the accompanying drawings.

DESCRIPTION OF EMBODIMENTS

1. Overall Arrangement

Figure 1:
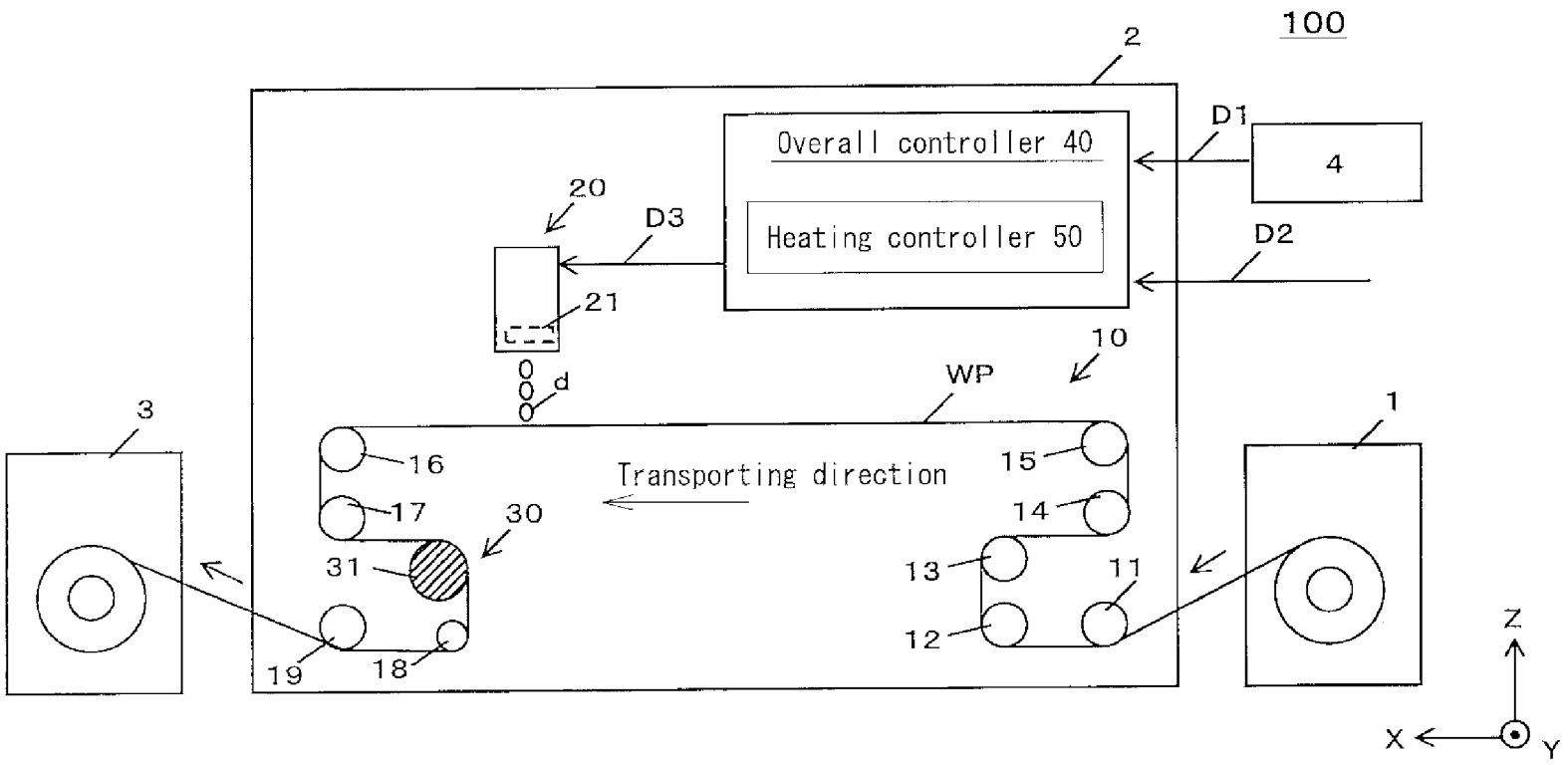
FIG. 1 is a general arrangement diagram of an inkjet printing device according to a preferred embodiment of the present invention.

FIG. 1 is a general arrangement diagram of an inkjet printing device according to a preferred embodiment of the present invention. Here, a coordinate system (X, Y, Z) in FIG. 1 is a coordinate system with a +Z-axis direction being a vertically upward direction and shall be defined as illustrated. Also, with respect to the paper surface, a front side is a +Y-axis direction and a back side is a −Y-axis direction.

The inkjet printing device 100 (referred to hereinafter as "printing device 100" where appropriate) performs printing on an elongated continuous paper WP (print medium). The printing device 100 includes a paper supplying portion 1, a printer main body 2, a paper delivery portion 3, and an input portion 4. The paper supplying portion 1 rotatably holds a roll of the continuous paper WP and supplies the continuous paper WP to the printer main body 2. The printer main body 2 performs printing on the supplied continuous paper WP and further heats and dries the continuous paper WP after printing. The printer main body 2 delivers the continuous paper WP that has been printed on and dried to the paper delivery portion 3. The paper delivery portion 3 winds up and recovers the delivered continuous paper WP in a roll. The input portion 4 is data input device such as a touch panel, a keyboard or the like, and an operator inputs target temperature data D1 for continuous paper WP via the input portion 4. The target temperature data D1 is data that designates target temperatures separately for a paper region R1 and a non-paper region R2 to be described below. Further, print data D2 is supplied to the printer main body 2 from an external device such as an image processing device.

The printer main body 2 includes a transporting unit 10, a printer unit 20, and a drying unit 30.

The transporting unit 10 includes a plurality of drive rollers 11, 15, 16, and 19 and a plurality of driven rollers 12, 13, 14, 17, and 18. The drive roller 11 is rotated by an unillustrated motor, draws out the continuous paper WP from the paper supplying portion 1 and transports it to the printer unit 20. The driven rollers 12 to 14 guide the continuous paper WP toward the drive roller 15. The drive roller 15 and the drive roller 16 are rotated by an unillustrated motor and transport the continuous paper WP in an X-axis direction (transporting direction). The driven roller 17 guides the continuous paper WP toward the drying unit 30. The driven roller 18 guides the continuous paper WP toward the drive roller 19. The drive roller 19 is driven by an unillustrated motor and delivers the continuous paper WP that has been printed on toward the paper delivery portion 3. The paper delivery portion 3 winds up and recovers the continuous paper WP that has been printed on and dried in a roll. The transporting unit 10 is arranged to be capable of transporting the continuous paper WP at different speeds in accordance with a type, etc., of the continuous paper WP (print medium).

The printer unit 20 is positioned above a transporting path of the continuous paper WP. In accordance with image data D3 included in the print data D2, the printer unit 20 discharges ink droplets d toward the continuous paper WP being transported in the X-axis direction to perform printing.

The printer unit 20 includes an inkjet head 21. The inkjet head 21 includes at least one nozzle column in which a plurality of nozzles (not shown) are aligned in Y-axis directions. The respective nozzles of the nozzle column discharge ink droplets d toward the continuous paper WP, that is, toward one surface (front surface) of the continuous paper WP in accordance with the image data to perform printing. The respective nozzles belonging to the same nozzle column discharge ink of the same color. Although the inkjet head 21 has at least one nozzle column, it may be arranged to be capable of realizing multicolor printing by discharging inks of different colors from a plurality of nozzle columns.

The drying unit 30 dries the continuous paper WP printed on by the printer unit 20. The drying unit 30 includes a heat roller 31. The heat roller 31 is a hollow cylindrical body with its rotational axis matched with the Y-axis directions and houses a plurality of heaters 34 (not shown in FIG. 1) in its internal space. The heat roller 31 heats and dries the continuous paper WP while winding a non-printed surface (other surface; rear surface) of the continuous paper WP around a portion of its outer peripheral surface. Details of the drying unit 30 shall be described later.

An overall controller 40 includes a CPU (central processing unit), a memory, etc., and receives the print data D2 for printing on the continuous paper WP from an external device such as an image editing device. The print data D2 includes the image data D3 of an image to be printed, paper data D4 indicating a paper size and a paper thickness necessary for printing, transporting speed data D5 indicating a transporting speed of the continuous paper WP during printing, etc.

The overall controller 40 controls the respective portions (paper supplying portion 1, printer main body 2, and paper delivery portion 3) of the printing device 100 in accordance with the received print data D2 to perform printing on the continuous paper WP by the printing device 100. That is, the overall controller 40 controls the printer unit 20 in accordance with the image data D3 extracted from the print data D2 to discharge ink droplets d toward the continuous paper WP from the inkjet head 21. Also, the overall controller 40 controls the paper supplying portion 1, the transporting unit 10, and the paper delivery portion 3 such that the continuous paper WP of the paper size indicated by the paper data D4 extracted from the print data D2 is transported at the transporting speed indicated by the transporting data D5 likewise extracted from the print data D2.

Further, the overall controller 40 includes a heating controller 50 arranged to control the drying unit 30. The heating controller 50 varies duty ratios of drive signals of the heaters 34 (see FIG. 2) of the heat roller 31. Details of the heating controller 50 shall be described later.

2. Drying Unit 30

Figure 2:
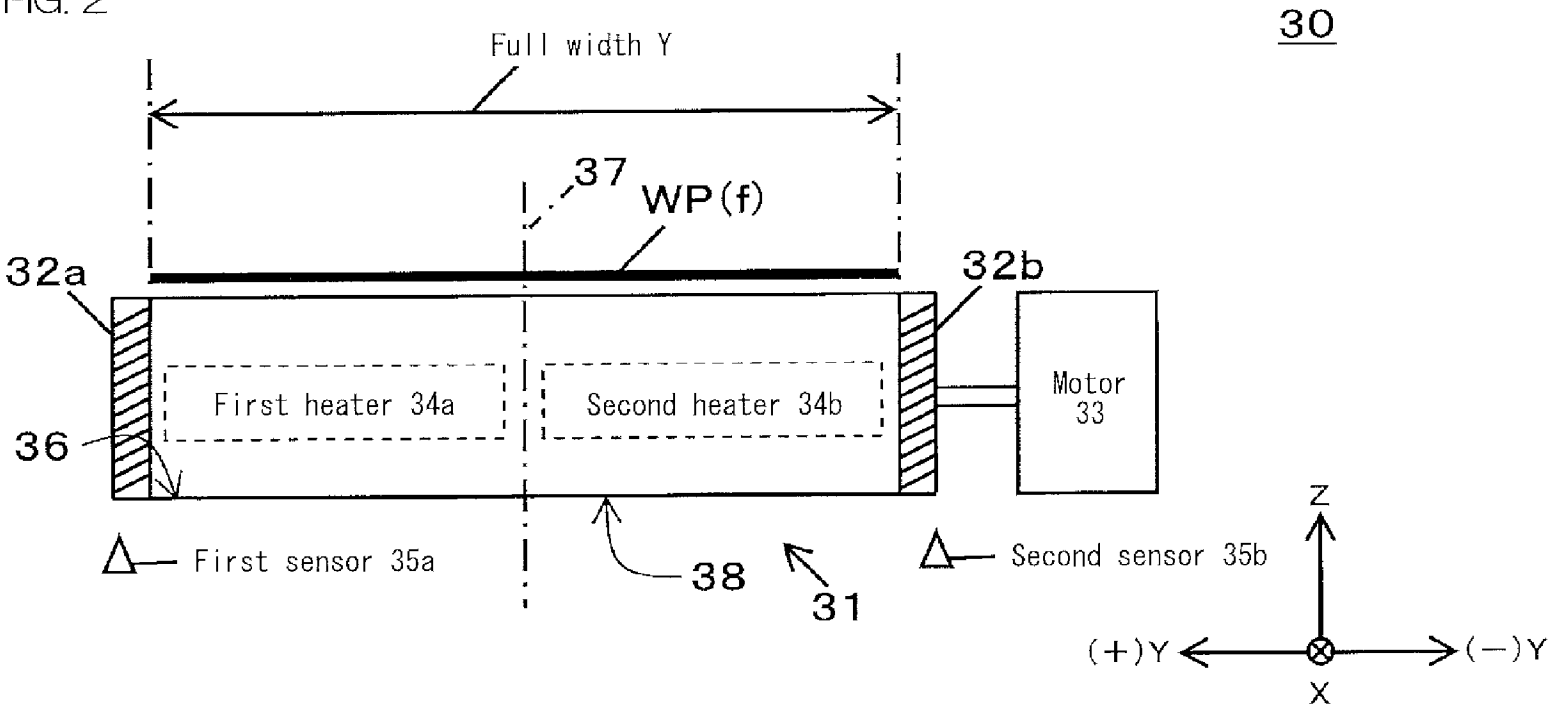
FIG. 2 is a schematic side view of a drying unit.

FIG. 2 is a schematic side view of the drying unit 30 as viewed in the X direction from the paper supplying portion 1 side. The drying unit 30 includes the heat roller 31 of hollow cylindrical shape that is elongated in the Y-axis directions, black bodies 32*a* and 32*b* disposed at respective end portions in the Y-axis directions of the heat roller 31, a motor 33 that rotates the heat roller 31, a first heater 34*a* and a second heater 34*b* that are disposed in an interior of the heat roller 31, a first sensor 35*a* disposed at a +Y-axis direction end portion of the heat roller 31, and a second sensor 35*b* disposed at a −Y-axis direction end portion of the heat roller 31. Hereinafter, a Y-axis direction length of the heat roller 31 excluding the black bodies 32*a* and 32*b* shall be referred to as the "full width Y."

The first heater 34*a* and the second heater 34*b* are, for example, halogen heaters and irradiate infrared rays in accordance with the duty ratios (intensities) of the drive signals to heat the heater roller 31 from an inner peripheral surface 36. The first heater 34*a* is positioned further to the +Y-axis direction side than a Y-direction middle position 37 (hereinafter abbreviated as the "middle position 37" where appropriate) of the heat roller 31 and the second heater 34*b* is positioned further to the −Y-axis direction side than the middle position 37. The heating controller 50 (see FIG. 1) controls outputs of the respective heaters 34*a* and 34*b* separately. That is, the heating controller 50 varies the duty ratios of the drive signals supplied to the respective heaters 34*a* and 34*b* to control the outputs of the respective heaters 34*a* and 34*b* separately. As each of the heaters 34*a* and 34*b*, a heater of any form can be adopted as long as it is capable of heating the inner peripheral surface 36 of the heat roller 31 and it can, for example, be a sheathed heater.

The first sensor 35*a* and the second sensor 35*b* are, for example, radiation thermometers and detect temperatures of an outer peripheral surface 38 of the heat roller 31 at locations opposing the respective sensors 35*a* and 35*b* (that is, a vicinity of a +Y-axis direction side end portion of the black body 32*a* and a −Y-axis direction side end portion of the black body 32*b*).

In the following, the first heater 34*a* and the second heater 34*b* shall be referred to generically as the "heater 34" where appropriate. Similarly, the first sensor 35*a* and the second sensor 35*b* shall be referred to generically as the "sensor 35" where appropriate.

As shown in FIG. 2, the continuous paper WP having a width of a length extending from the +Y-axis direction end portion to the −Y-axis direction end portion of the heat roller 31 excluding the blackbodies 32*a* and 32*b* can be wound in close contact around the outer peripheral surface 38 of the heat roller 31. In the following, the continuous paper WP of this width may be referred to at times as the "full-width continuous paper WP(f)." Also, it is possible to wind continuous papers WP of various widths shorter than the full-width continuous paper WP(f) around the outer peripheral surface 38 of the heat roller 31.

3. Winding Position

Figure 3:
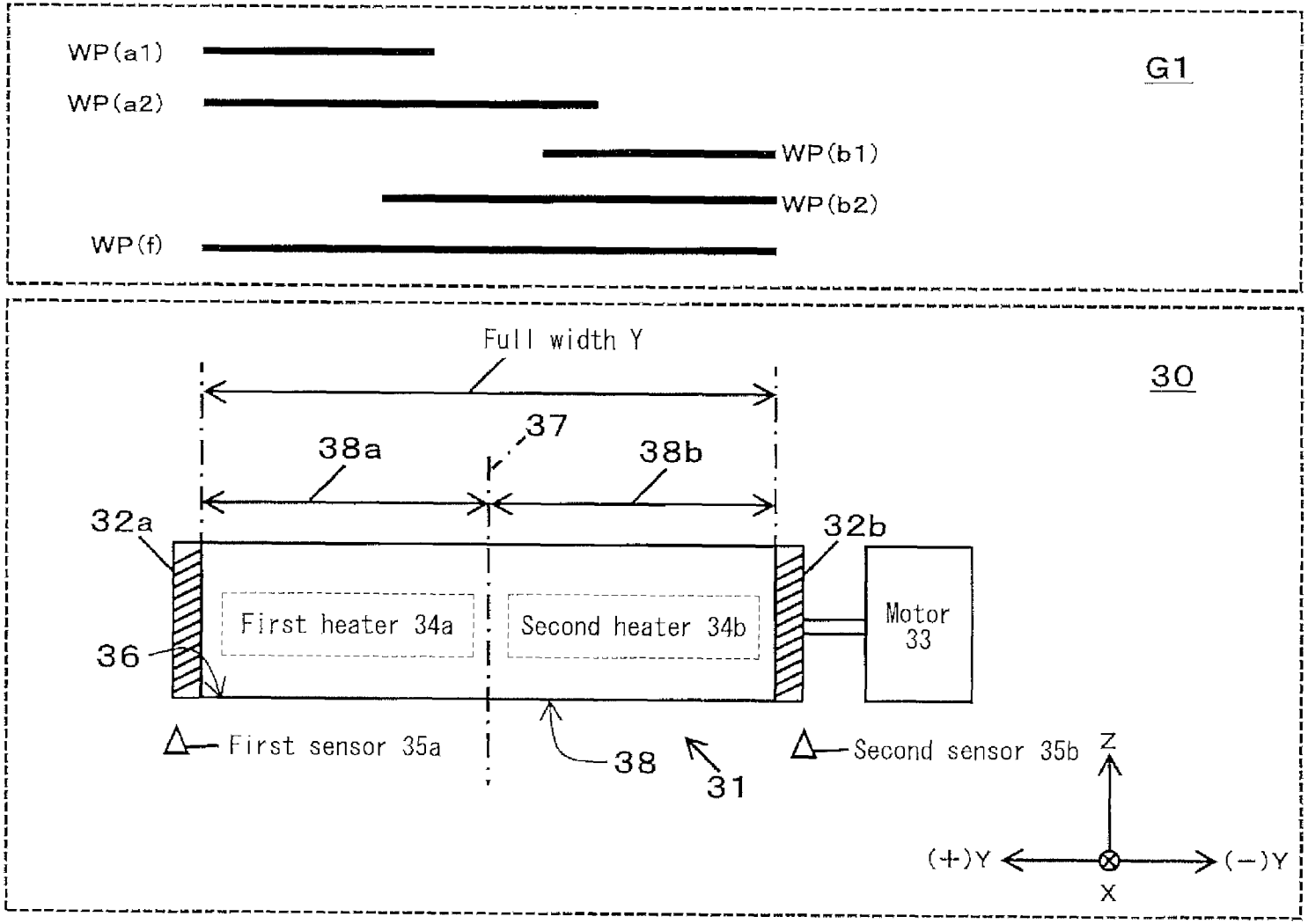
FIG. 3 is a diagram showing the schematic side view of the drying unit alongside a graph indicating winding positions of continuous papers.

FIG. 3 is an explanatory diagram showing the side view of the drying unit 30 shown in FIG. 2 alongside a graph G1 for describing winding positions of continuous papers WP of respective widths around the heat roller 31. The outer peripheral surface 38 is divided into a +Y-axis direction side region (first outer peripheral surface 38*a*) and a −Y-axis direction side region (second outer peripheral surface 38*b*) around the Y-direction middle position 37. When the full-width continuous paper WP(f) is wound around the heat roller 31, both the first outer peripheral surface 38*a* and the second outer peripheral surface 38*b* are used.

The first outer peripheral surface 38*a* can be used for winding a continuous paper WP(a1) of width shorter than ½ the total width Y and a continuous paper WP(a2) of width slightly longer than ½ the total width Y. Similarly, the second outer peripheral surface 38*b* can be used for winding a continuous paper WP(b1) of width shorter than ½ the total width Y and a continuous paper WP(b2) of width slightly longer than ½ the total width Y. A specific length of the total width Y is, for example, 520 mm. A maximum width of a continuous paper WP that is wound using a full width of the first outer peripheral surface 38*a* and a partial width of the second outer peripheral surface 38*b* is, for example, 350 mm. Similarly, a maximum width of a continuous paper WP that is wound using a full width of the second outer peripheral surface 38*b* and a partial width of the first outer peripheral surface 38*a* is, for example, 350 mm. Here, the continuous paper WP(a2) is deemed to be a continuous paper WP of maximum width that is wound using the full width of the first outer peripheral surface 38*a* and the partial width of the second outer peripheral surface 38*b* and the continuous paper WP(b2) is deemed to be a continuous paper WP of maximum width that is wound using the full width of the second outer peripheral surface 38*b* and the partial width of the first outer peripheral surface 38*a*. In the following, the continuous paper WP(a1) and the continuous paper WP(a2) shall be referred to generically as the "first narrow-width continuous paper WP(a)" where appropriate. Similarly, the continuous paper WP(b1) and the continuous paper WP(b2) shall be referred to generically as the "second narrow-width continuous paper WP(b)" where appropriate. Further, the "first narrow-width continuous paper WP(a)" and the "second narrow-width continuous paper WP(b)" shall be referred to generically as the "narrow-width continuous paper WP(n)" where appropriate.

The outer peripheral surface 38 at the side around which the full width or most of the narrow-width continuous paper WP(n) is wound when the narrow-width continuous paper WP(n) is used is referred to as a "paper region R1." That is, since the outer peripheral surface 38 at the side around which the full width or most of the first narrow-width continuous paper WP(a) is wound is the first outer peripheral surface 38*a*, the first outer peripheral surface 38*a* is the "paper region R1" for the first narrow-width continuous paper WP(a). On the other hand, since the outer peripheral surface 38 at the side around which the full width or most of the second narrow-width continuous paper WP(b) is wound is the second outer peripheral surface 38*b*, the second outer peripheral surface 38*b* is the "paper region R1" for the second narrow-width continuous paper WP(b). Also, the outer peripheral surface 38 at the side that does not correspond to the paper region R1 is called a "non-paper region R2."

The first heater 34*a* is provided in correspondence to the first outer peripheral surface 38*a* and heats the outer peripheral surface 38 from the side of the first outer peripheral surface 38*a*. The second heater 34*b* is provided in correspondence to the second outer peripheral surface 38*b* and heats the outer peripheral surface 38 from the side of the second outer peripheral surface 38*b*.

4. Temperature Distribution

Figure 4:
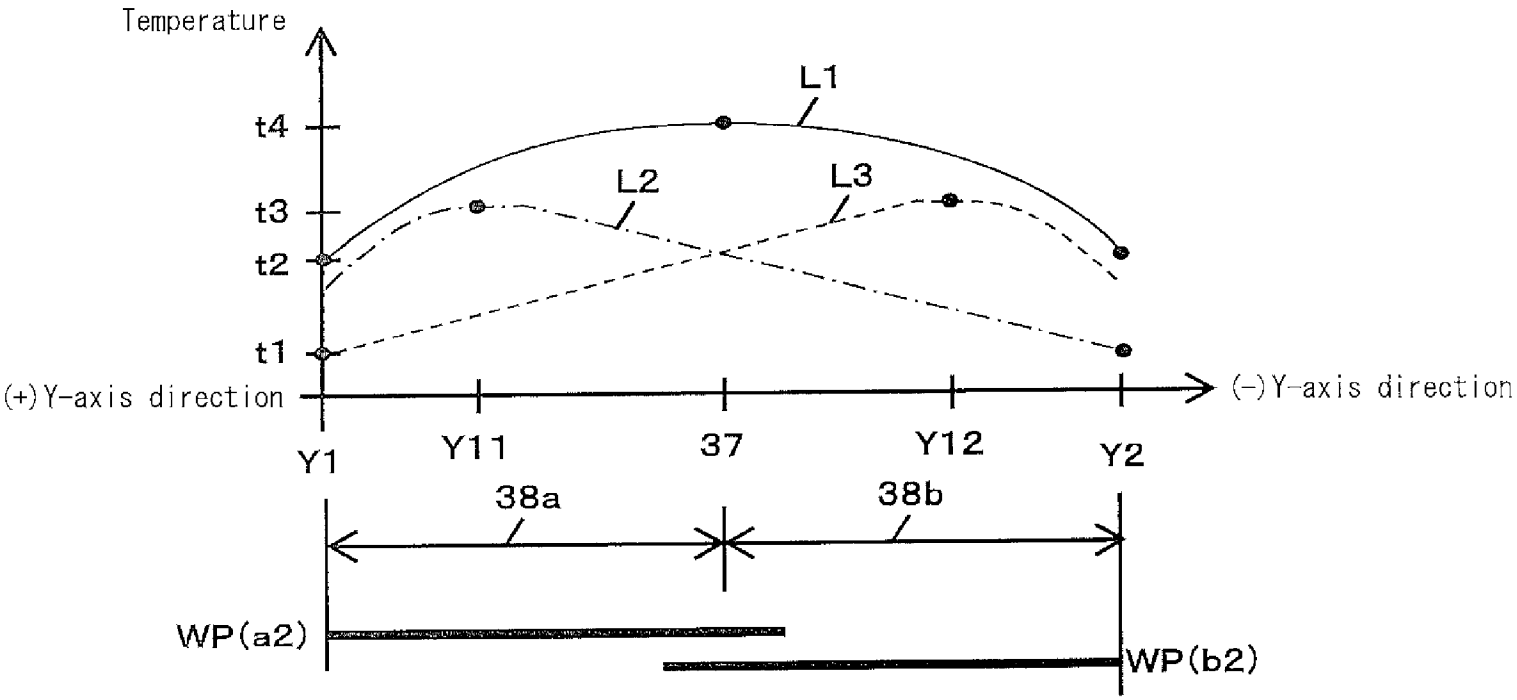
FIG. 4 is a diagram showing an example of a temperature distribution of a heat roller.

FIG. 4 is an explanatory diagram showing a temperature distribution of the outer peripheral surface 38 of the heat roller 31. The abscissa of FIG. 4 represents a Y-axis direction position and the ordinate represents a temperature of the outer peripheral surface 38. A symbol "Y1" indicates a position of the +Y-axis direction side end portion of the heat roller 31 excluding the black bodies 32*a* and 32*b* (hereinafter referred to as the "first end portion Y1") and a symbol "Y2" indicates a position of the −Y-axis direction side end portion of the heat roller 31 excluding the black bodies 32*a* and 32*b* (hereinafter referred to as the "second end portion Y2").

In FIG. 4, a curve L1 represented by a solid line is a temperature distribution of the outer peripheral surface 38 when the first heater 34*a* and the second heater 34*b* are driven at the maximum duty ratios. The temperature distribution curve L1 exhibits a maximum value (temperature t4) at the middle position 37 and exhibits a minimum value (temperature t2) at the first end portion Y1 and the second end portion Y2. By varying the duty ratios of the drive signals for the first heater 34*a* and the second heater 34*b* at not more than the maximum duty ratios, the temperature distribution curve L1 that expresses the temperature distribution of the first outer peripheral surface 38*a* and the second outer peripheral surface 38*b* changes such as to move up and down in a range not higher than the position shown in FIG. 4. By moving the temperature distribution curve L1 up and down, the full-width continuous paper WP(f) can be heated at a desired temperature.

In FIG. 4, a curve L2 represented by an alternate long and short dashed line is a temperature distribution of the outer peripheral surface 38 when the first heater 34*a* is driven at the maximum duty ratio with the second heater 34*b* being turned off. The temperature distribution curve L2 exhibits a maximum value (temperature t3) at a substantially middle position Y11 between the first end portion Y1 and the middle position 37 and exhibits a minimum value (temperature t1) at the second end portion Y2. By varying the duty ratio of the drive signal for the first heater 34*a* at not more than the maximum duty ratio, the temperature distribution curve L2 that expresses the temperature distribution of the first outer peripheral surface 38*a* and the second outer peripheral surface 38*b* changes such as to move up and down in a range not higher than the position shown in FIG. 4. By moving the temperature distribution curve L2 up and down, the first narrow-width continuous paper WP(a) can be heated at a desired temperature.

In FIG. 4, a curve L3 represented by a broken line is a temperature distribution of the outer peripheral surface 38 when the second heater 34*b* is driven at the maximum duty ratio with the first heater 34*a* being turned off. The temperature distribution curve L3 exhibits a maximum value (temperature t3) at a substantially middle position Y12 between the second end portion Y2 and the middle position 37 and exhibits a minimum value (temperature t1) at the first end portion Y1. By varying the duty ratio of the drive signal for the second heater 34*b* at not more than the maximum duty ratio, the temperature distribution curve L3 that expresses the temperature distribution of the first outer peripheral surface 38*a* and the second outer peripheral surface 38*b* changes such as to move up and down in a range not higher than the position shown in FIG. 4. By moving the temperature distribution curve L3 up and down, the second narrow-width continuous paper WP(b) can be heated at a desired temperature.

With the printing device 100, the heater 34 corresponding to the paper region R1 is mainly used when heating the narrow-width continuous paper WP(n). That is, the first heater 34*a* is mainly used for heating the first narrow-width continuous paper WP(a) and the second heater 34*b* is mainly used for heating the second narrow-width continuous paper WP(b).

However, there are times where the heating controller 50 (a heater controller 52 to be described below) judges that the narrow-width continuous paper WP(n) cannot be heated at a designated target temperature with just the heater 34 of the paper region R1. In this case, the heating controller 50 (heater controller 52) uses the heater 34 for the non-paper region R2 supplementarily to perform supplementary heating of the narrow-width continuous paper WP(n) wound around the paper region R1.

5. Heating Controller 50

Figure 5:
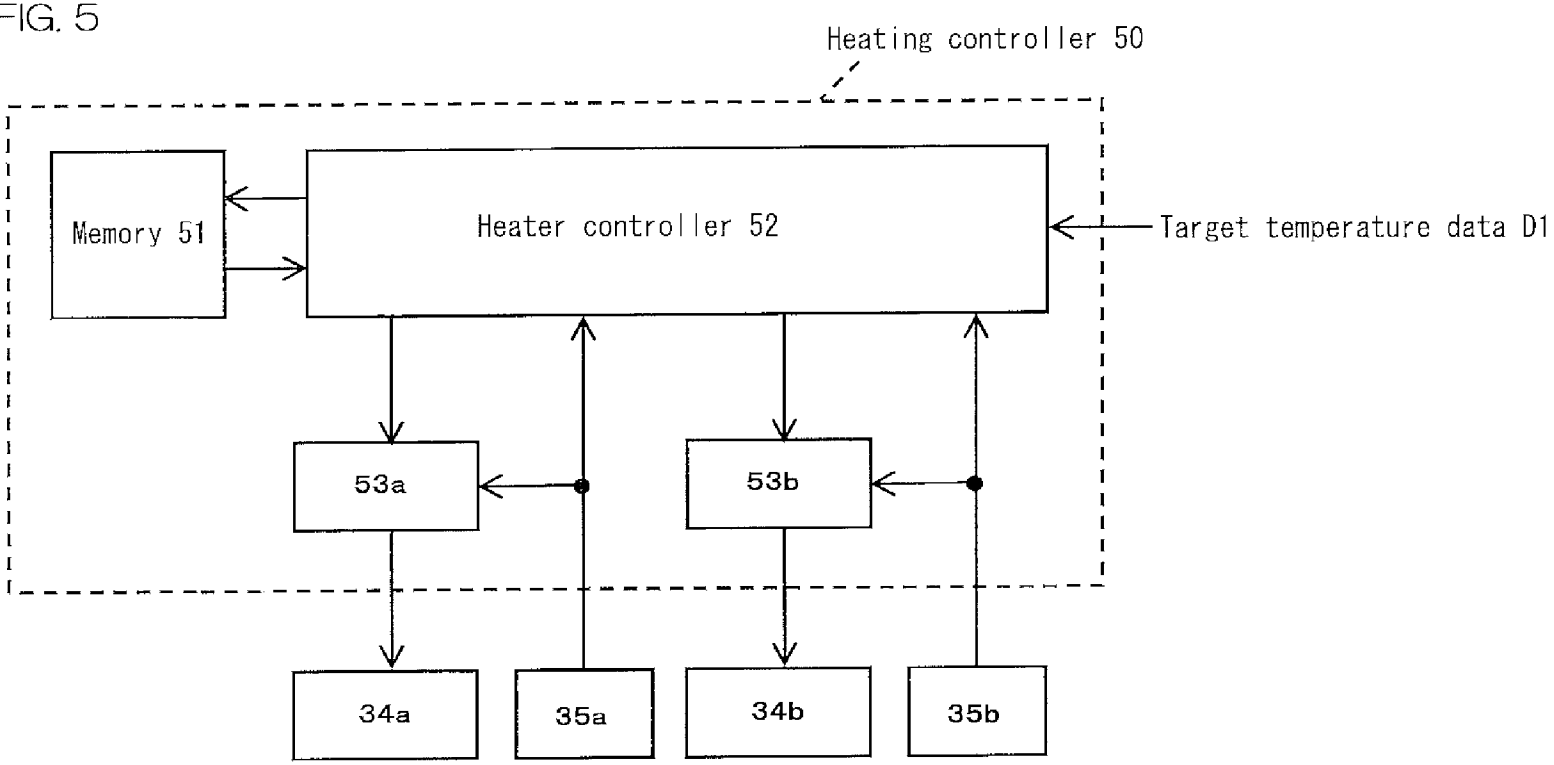
FIG. 5 is a block diagram of a heating controller.

FIG. 5 is a block diagram of the heating controller 50. The heating controller 50 includes a memory 51, the heater controller 52, a first heater drive circuit 53*a*, and a second heater drive circuit 53*b*.

The first heater drive circuit 53*a* is a feedback control circuit and supplies to the first heater 34*a* the drive signal of the duty ratio calculated based on a difference between the temperature of the first outer peripheral surface 38*a* detected by the first sensor 35*a* and a target temperature set in advance. Similarly, the second heater drive circuit 53*b* is also a feedback control circuit and supplies to the second heater 34*b* the drive signal of the duty ratio calculated based on a difference between the temperature of the second outer peripheral surface 38*b* detected by the second sensor 35*b* and a target temperature set in advance.

The memory 51 stores a "thermal contribution ratio" of the non-paper region R2 side heater 34 with respect to the paper region R1. With the printer device 100, the thermal contribution ratio from the heater 34 at the non-paper region R2 side to the paper region R1 is taken into consideration when heating the narrow-width continuous paper WP(n) by the heater 34 at the non-paper region R2 side. The thermal contribution ratio shall now be described using the temperature distribution curve L3 in FIG. 4.

The thermal contribution ratio is a value that represents a degree to which the heater 34 (here, the second heater 34*b*) at the non-paper region R2 (shall be the second outer peripheral surface 38*b* here) side contributes to temperature rise of the paper region R1 (here, the first outer peripheral surface 38*a*). In this case, the thermal contribution ratio can be determined, for example, by dividing the maximum temperature t3 when the second heater 34*b* is driven at the maximum duty ratio by the minimum temperature t1. The maximum temperature t3 is obtained at the non-paper region R2 and the minimum temperature t1 is obtained at the paper region R1. A heat amount corresponding to the maximum temperature t3 at the non-paper region R2 is heat transferred to the paper region R1 while being attenuated to the minimum temperature t1. The thermal contribution ratio represents a degree of thermal influence that the heater 34 at the non-paper region R2 applies to the paper region R1.

The thermal contribution ratio is used to convert a deficient heat amount equivalent value (for example, an intensity deficit of the drive signal or a temperature deficit) at the paper region R1 side to a control value of the heater 34 at the non-paper region R2 side (for example, a target duty ratio of the drive signal of the non-paper region R2 side heater 34 or the target temperature of the non-paper region R2).

6. First Control Example: Heating Control Flow (NARROW-WIDTH CONTINUOUS PAPER WP(N): DUTY RATIO CONTROL)

Figure 6:
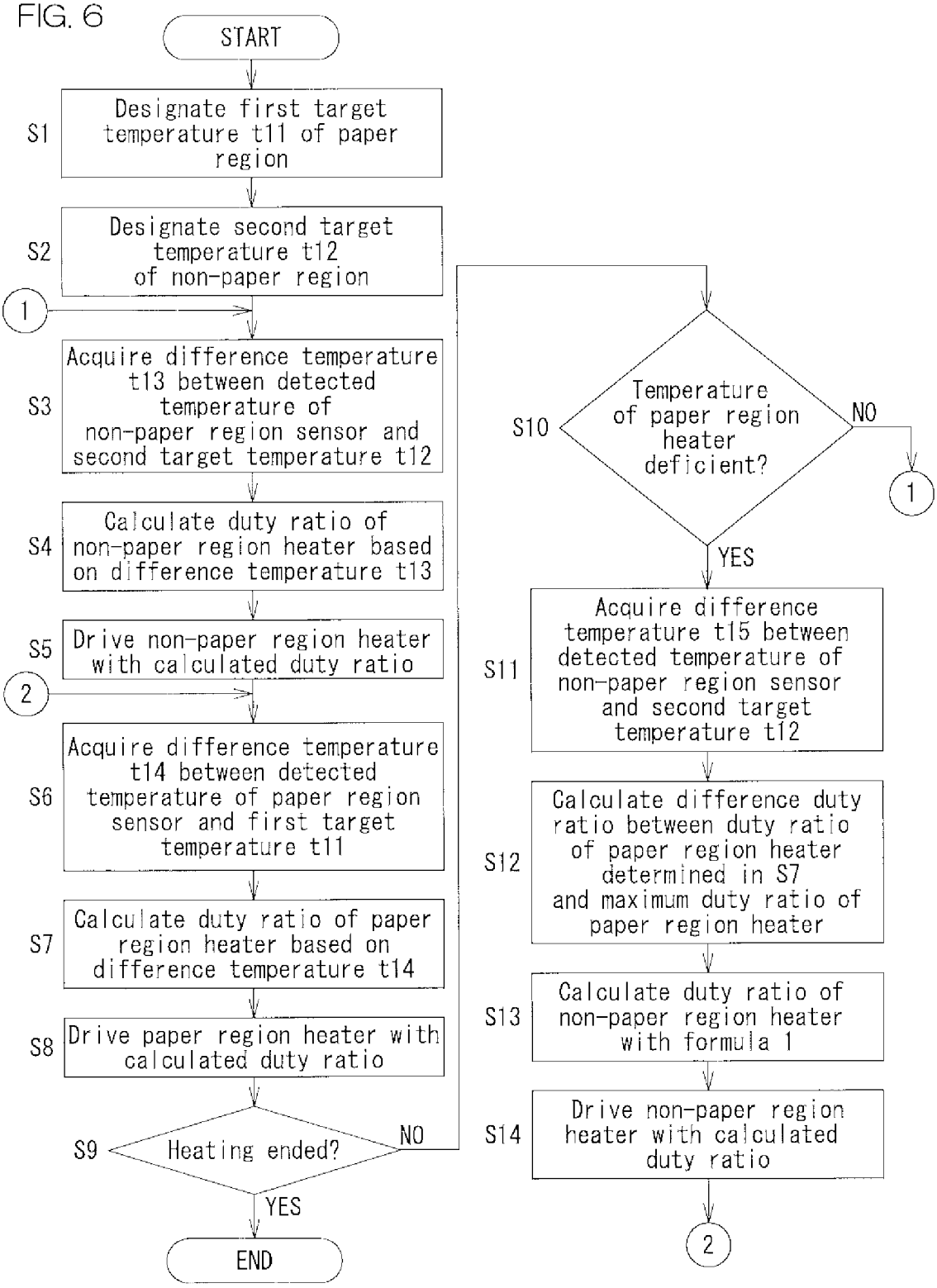
FIG. 6 is a flowchart for describing a first example of heating control of a narrow-width continuous paper.

Next, an example of heating control for the narrow-width continuous paper WP(n) shall be described using FIG. 5 and FIG. 6. In the present example, the deficient heat amount equivalent value at the paper region R1 side is calculated based on the duty ratio of the drive signal for the paper region R1 side heater 34. FIG. 6 is a flowchart for performing the heating control of the narrow-width continuous paper WP(n) using the heater 34. Here, it shall be deemed that the first narrow-width continuous paper WP(a) is used as the narrow-width continuous paper WP(n).

Step S1

The operator inputs the target temperature data D1 from the input portion 4. That is, the operator inputs the target temperature (first target temperature t11) for the paper region R1 side as the target temperature data D1 from the input portion 4. The heater controller 52 receives the data and sets the first target temperature t11 in the paper region R1 side heater drive circuit 53 (first heater drive circuit 53*a*). The input portion 4 corresponds to the target temperature providing means in the preferred embodiment of the present invention.

Step S2

Further, if the non-paper region R2 side heater 34 (second heater 34*b*) is to be used in combination for heating the continuous paper WP, the operator inputs the target temperature (second target temperature t12) for the non-paper region R2 side as the target temperature data D1 from the input portion 4. The heater controller 52 receives the data and sets the second target temperature t12 in the non-paper region R2 side heater drive circuit 53 (second heater drive circuit 53*b*).

Step S3

The second heater drive circuit 53*b* acquires a difference temperature t13 between the output of the non-paper region R2 side sensor 35 (second sensor 35*b*) and the second target temperature t12 set in step S1.

Step S4

The second heater drive circuit 53*b* calculates the duty ratio of the heater 34 at the non-paper region R2 side (second heater 34*b*) based on the difference temperature t13.

Step S5

The second heater drive circuit 53*b* drives the second heater 34*b* with the drive signal of the duty ratio calculated in step S4.

Step S6

The first heater drive circuit 53*a* acquires a difference temperature t14 between the output of the paper region R1 side sensor 35 (first sensor 35*a*) and the first target temperature t11 set in step S1.

Step S7

The first heater drive circuit 53*a* calculates the duty ratio of the drive signal for the paper region R1 side heater 34 (first heater 34*a*) based on the difference temperature t14.

Step S8

The first heater drive circuit 53*a* drives the first heater 34*a* with the drive signal of the duty ratio calculated in step S7. An upper limit temperature is set for the paper region R1 and the first heater drive circuit 53*a* calculates the duty ratio of the drive signal within a limit of not exceeding the upper limit temperature.

Step S9

The heater controller 52 judges whether or not to end the heating process. If the heating process is to be ended, an ending mode is entered. If ending is not to be performed, step S10 is entered.

Step S10

The heater controller 52 references the output of the sensor 35 at the paper region R1 side (first sensor 35*a*) and judges whether or not the heater temperature of the paper region R1 is deficient. Until a fixed time elapses from a start of heating by the first heater 34*a*, the heater controller 52 makes a "No" judgment regardless of whether or not the paper region R1 has reached the first target temperature t11, returns to step S3, and repeats the process loop from step S3 to S9 again. On the other hand, if, after the fixed time has elapsed from the start of heating by the first heater 34*a*, the paper region R1 has not reached the first target temperature t11, a "Yes" judgment is made and step S11 is entered. That the "Yes" judgment is made in step S10 means that it has been judged that the temperature of the paper region R1 side heater 34 is deficient and supplementary heating by the non-paper region R2 side heater 34 is necessary. The fixed time is, for example, a time such that within its elapse, the duty ratio of the drive signal for the first heater 34*a* rises to a saturated state (the maximum duty ratio). The heater controller 52 corresponds to the judging means in the preferred embodiment of the present invention.

When the "Yes" judgment is made in step S10, the heater controller 52 enters step S11. From step S11 onward, the non-paper region R2 side heater 34 (second heater 34*b*) is used supplementarily to perform supplementary heating of the narrow-width continuous paper WP(n) wound around the paper region R1.

Step S11

The heater controller 52 acquires a difference temperature t15 between the temperature of the non-paper region R2 detected by the non-paper region R2 side sensor 35 (second sensor 35*b*) and the second target temperature t12.

Step S12

The heater controller 52 calculates a difference duty ratio between the duty ratio of the drive signal for the first heater 34*a* determined in step S7 and the maximum duty ratio of the drive signal for the first heater 34*a*. For example, if the duty ratio determined in S7 is 120% and the maximum duty ratio is 100%, the difference duty ratio is 20%. This difference duty ratio expresses the heat amount deficient at the paper region R1 side as a duty ratio of a heater drive signal.

Step S13

The heater controller 52 calculates the duty ratio of the drive signal of the heater at the non-paper region R2 side (second heater 34*b*) by the following formula 1.

"Duty ratio of drive signal of non-paper region side heater"="Duty ratio calculated based on difference temperature *t*15"+{"Difference duty ratio determined in *S*12"×Thermal contribution ratio} (Formula 1)

The first term of the right-hand side of formula 1 represents a unique duty ratio required at the non-paper region R2 side. The second term of the right-hand side of formula 1 is a duty ratio corresponding to a heat amount necessary for supplementary heating of the paper region R1. These are added to determine the duty ratio of the drive signal of the heater 34 at the non-paper region R2 side (second heater 34*b*).

Step S14

The heater controller 52 applies the duty ratio calculated in step 13 to the second heater drive circuit 53*b*. The second heater drive circuit 53*b* drives the second heater 34*b* with the drive signal of this duty ratio. Consequently, the second heater 34*b* is driven at the duty ratio (intensity) that is in accordance with the deficient heat amount equivalent value in the paper region R1. The heater controller 52 thereafter returns to step S6. An upper limit temperature is set for the non-paper region R2 and the second heater drive circuit 53*b* calculates the duty ratio of the drive signal within a limit of not exceeding the upper limit temperature.

With the present control example, the deficient heat amount equivalent value at the paper region R1 side is calculated using the duty ratio of the drive signal of the paper region R1 side heater and the duty ratio of the drive signal of the non-paper region R2 side heater 34 is set such as to compensate for the deficient heat amount equivalent value. The duty ratio of the drive signal of the non-paper region R2 side heater 34 can thus be set accurately.

7. Second Control Example: Heating Control Flow (NARROW-WIDTH CONTINUOUS PAPER WP(N): TEMPERATURE CONTROL)

Figure 7:
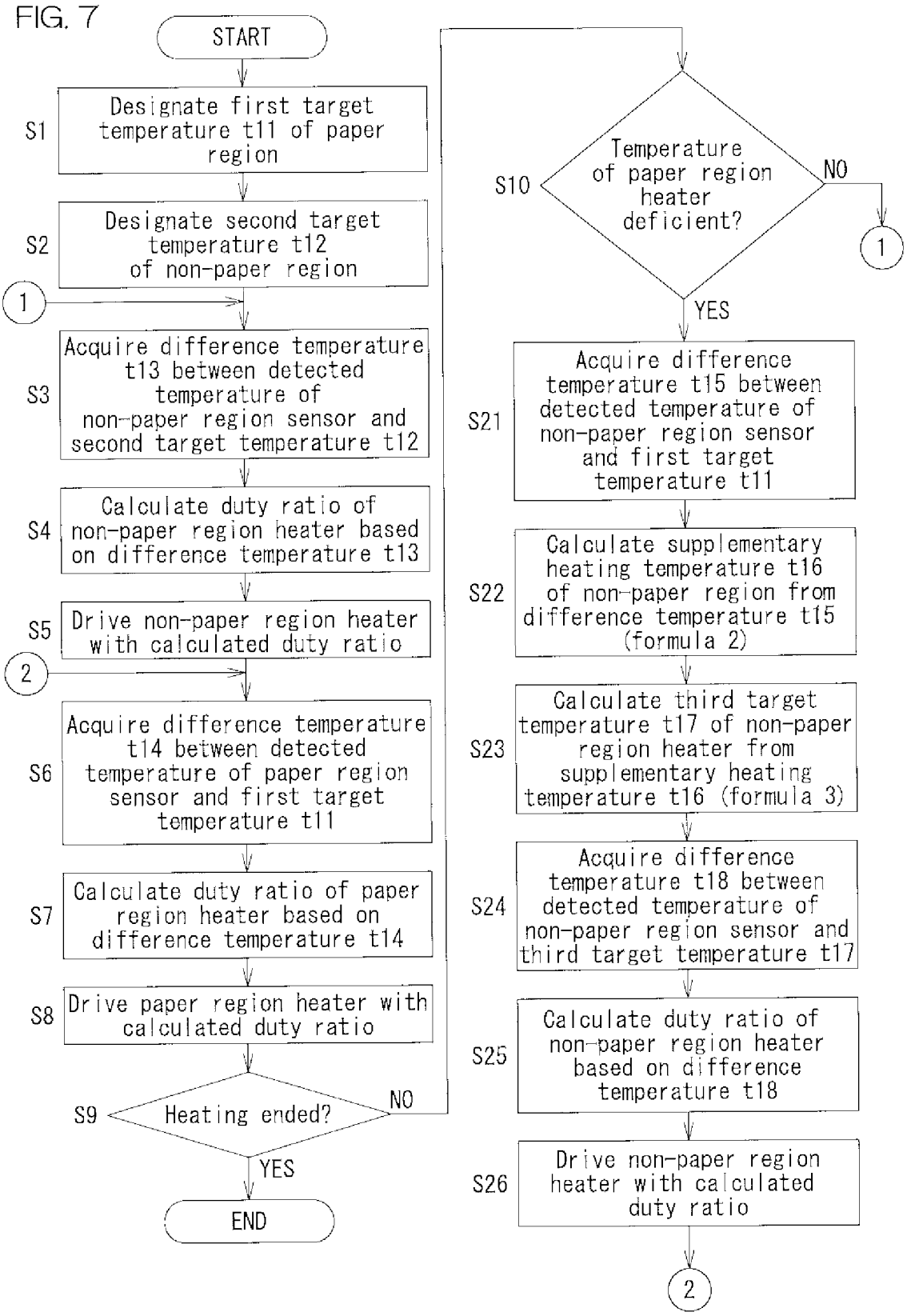
FIG. 7 is a flowchart for describing a second example of heating control of a narrow-width continuous paper.

Next, another example of heating control for the narrow-width continuous paper WP(n) shall be described using FIG. 5 and FIG. 7. In the present example, the deficient heat amount equivalent value at the paper region R1 side is calculated based on the temperature of the paper region R1. FIG. 7 is a flowchart for performing the heating control of the narrow-width continuous paper WP(n) using the heater 34. Here, it shall be deemed that the first narrow-width continuous paper WP(a) is used as the narrow-width continuous paper WP(n).

The processes from step S1 to step S10 are the same as those of the first control example and therefore description thereof shall be omitted.

Step S21

The heater controller 52 acquires a difference temperature t15 between the detected temperature of the sensor 35 of the paper region R1 (first sensor 35*a*) and the first target temperature t11. The difference temperature t15 corresponds to the deficient heat amount at the paper region R1 side.

Step S22

The heater controller 52 calculates a supplementary heating temperature t16 at the non-paper region R2 side by the following formula 2. The supplementary heating temperature t16 corresponds to a heat amount by which the non-paper region R2 side heater 34 (second heater 34*b*) compensates the deficient heat amount equivalent value at the paper region R1 side.

Supplementary heating temperature *t*16=Difference temperature *t*15×Thermal contribution ratio (Formula 2)

Step S23

The heater controller 52 resets the target temperature at the non-paper region R2 side to compensate for the deficient heat amount at the paper region R1 side detected in step S21. That is, a third target temperature t17 is calculated by the following formula 3 and the third target temperature t17 is reset in the heater drive circuit 53 at the non-paper region R2 side (second heater drive circuit 53*b*).

Third target temperature *t*17=Supplementary heating temperature *t*16+Second target temperature *t*12 (Formula 3)

Step S24

The second heater drive circuit 53*b* acquires a difference temperature t18 between the output of the second sensor 35*b* and the third target temperature t17.

Step S25

The second heater drive circuit 53*b* calculates the duty ratio of the drive signal of the second heater 34*b* based on the difference temperature t18. In this calculation, the second heater drive circuit 53*b* calculates the duty ratio of the drive signal within the limit of not exceeding the upper limit temperature set in advance for the non-paper region R2.

Step S26

The second heater drive circuit 53*b* drives the second heater 34*b* with the drive signal of the duty ratio calculated in step S25.

With the present control example, the heat amount deficient at the paper region R1 side is estimated using the deficient temperature at the paper region R1 side. The supplementary heating temperature t16 necessary to compensate for the deficient heat amount equivalent value at the paper region R1 side by the heater 34 at the non-paper region R2 side is calculated by referencing the thermal contribution ratio. Thereupon, the duty ratio of the drive signal of the non-paper region R2 side heater 34 is set such that the third target temperature t17 obtained by adding the supplementary heating temperature t16 to the second target temperature t12 that is the original target temperature of the non-paper region R2 can be realized at the non-paper region R2 side. The duty ratio of the drive signal can thus be set accurately.

8. Printing Process

When the heating controller 50 raises the temperature of the outer peripheral surface 38 of the heat roller 31 to a temperature suited for printing by the process related to the first or second control example, the overall controller 40 supplies necessary signals to the transporting unit 10 and the printer unit 20, etc., and starts printing onto the continuous paper WP.

9. Modification Example

Although the continuous paper WP is used as the print medium in the preferred embodiment described above, the present invention can also be implemented even if the print medium is a sheet. Also, although with the preferred embodiment described above, the heater 34 incorporated in the heat roller 31 is used, the present invention can also be implemented even in a case of using a heater 34 that heats the outer peripheral surface 38 from an exterior of the heat roller 31. Further, the temperature of the heat roller 31 can be detected by any of various methods. For example, the continuous paper WP may be interposed between the sensor 35 and the black body 32 when the sensor 35 measures the temperature of the outer peripheral surface 38 of the heat roller 31.

While preferred embodiments of the present invention have been described in detail above, these are merely specific examples used to clarify the technical content of the present invention, and the present invention should not be interpreted as being limited only to these specific examples, and the scope of the present invention shall be limited only by the appended claims.

REFERENCE SIGNS LIST

1 paper supplying portion
2 printer main body
3 paper delivery portion
10 transporting unit
20 printer unit
21 inkjet head
30 drying unit
31 heat roller
32 black body
33 motor
34*a* first heater
34*b* second heater
35*a* first sensor
35*b* second sensor
38*a* first outer peripheral surface
38*b* second outer peripheral surface
40 overall controller
50 heating controller
51 memory
52 heater controller
53*a* first heater drive circuit
53*b* second heater drive circuit
100 inkjet printing device (printing device)

The invention claimed is:

1. An inkjet printing device comprising:

a transporting unit that transports a print medium;

a printhead that discharges ink droplets onto the print medium transported by the transporting unit to perform printing on the print medium;

a heat roller that is elongated in a direction orthogonal to a transporting direction of the print medium and includes a peripheral surface with which the print medium comes into contact after printing by the printhead, the peripheral surface including a paper region with which a full width or most of the print medium comes into contact and a non-paper region other than the paper region;

a first heater that is provided in correspondence to the paper region and heats the peripheral surface;

a second heater that is provided in correspondence to the non-paper region and heats the peripheral surface;

a data input device that provides a target temperature at the paper region side;

a sensor that measures a temperature at the paper region side;

a controller programed to function as a judging means that references the target temperature and an output of the sensor in a state where heating of the peripheral surface by the first heater is performed to judge whether or not supplementary heating of the paper region by the second heater is necessary; and a heater drive circuit that drives the second heater by a drive signal of an intensity in accordance with a deficient heat amount equivalent value in the paper region if it is judged by the judging means that supplementary heating of the paper region is necessary.

2. The inkjet printing device according to claim 1, wherein the first heater and the second heater are juxtaposed in an axial direction of the heat roller.

3. The inkjet printing device according to claim 1, wherein a difference temperature between the target temperature and the sensor output is used as the deficient heat amount equivalent value in the paper region.

4. The inkjet printing device according to claim 1, wherein a difference between a duty ratio of a drive signal for the first heater calculated from the sensor output and a maximum duty ratio of the drive signal for the first heater is used as the deficient heat amount equivalent value in the paper region.

5. The inkjet printing device according to claim 1, wherein the heater drive circuit drives the second heater in consideration of a thermal contribution ratio of the second heater from the non-paper region to the paper region.

6. A print medium heating method of an inkjet printing device including a transporting unit that transports a print medium, a printhead that discharges ink droplets onto the print medium transported by the transporting unit to perform printing on the print medium, a heat roller that is elongated in a direction orthogonal to a transporting direction of the print medium and includes a peripheral surface with which the print medium comes into contact after printing by the printhead, the peripheral surface including a paper region with which a full width or most of the print medium comes into contact and a non-paper region other than the paper region, a first heater that is provided in correspondence to the paper region and heats the peripheral surface, a second heater that is provided in correspondence to the non-paper region and heats the peripheral surface, and a sensor that measures a temperature at the paper region side, the print medium heating method comprising:

a target temperature providing step of providing a target temperature at the paper region side;

a temperature measuring step of measuring a temperature at the paper region side in a state where heating of the peripheral surface by the first heater is performed and outputting a measured temperature;

a judging step of referencing the target temperature and the measured temperature and judging whether or not supplementary heating of the paper region by the second heater is necessary; and a second heater driving step of generating a drive signal of an intensity in accordance with a deficient heat amount equivalent value in the paper region and driving the second heater if it is judged by the judging step that supplementary heating of the paper region is necessary.

* * * * *